US005724759A

United States Patent [19]

Kilham

[11] Patent Number: 5,724,759

[45] Date of Patent: Mar. 10, 1998

[54] SAFETY MECHANISM FOR SINGLE ACTION FIREARMS

[76] Inventor: Benjamin Kilham, P.O. Box 37, Lyme, N.H. 03768

[21] Appl. No.: 735,502

[22] Filed: Oct. 23, 1996

[51] Int. Cl.[6] ..... F41A 17/00

[52] U.S. Cl. ..... 42/66

[58] Field of Search ..... 42/66, 70.01, 70.04, 42/70.08; 89/142, 147, 148

[56] References Cited

U.S. PATENT DOCUMENTS

| | | | |
|---|---|---|---|
| 308,513 | 11/1884 | Newcomb . | |
| 545,672 | 9/1895 | Browning . | |
| 887,784 | 5/1908 | Fyrberg . | |
| 2,945,316 | 7/1960 | Mulno | 42/66 |
| 3,086,310 | 4/1963 | Katz | 42/66 |
| 3,738,042 | 6/1973 | Ruger et al. | 42/66 |
| 3,777,384 | 12/1973 | Ruger et al. | 42/66 |
| 3,975,852 | 8/1976 | Findlay | 42/40 |
| 3,988,848 | 11/1976 | Chatigny | 42/70 F |
| 4,449,312 | 5/1984 | Ruger et al. | 42/66 |
| 4,575,963 | 3/1986 | Ruger et al. | 42/70 F |
| 4,680,884 | 7/1987 | Smith, Jr. et al. | 42/66 |
| 4,962,606 | 10/1990 | Pozzi | 42/70.08 |
| 5,548,914 | 8/1996 | Anderson | 42/66 |
| 5,560,132 | 10/1996 | Merlind | 42/66 |

*Primary Examiner*—Charles T. Jordan
*Assistant Examiner*—Meena Chelliah
*Attorney, Agent, or Firm*—Michael J. Weins

[57] ABSTRACT

The present invention is a safety mechanism for single action firearms, the safety mechanism having a trigger block slidably engaged with a safety channel in the firearm's frame. The trigger block has a block lower region configured to engage the firearm's trigger such that rotation of the trigger to a hammer release position moves the trigger block from a lower trigger block position to an upper trigger block position. The trigger block also has a block upper region, configured such that, when the trigger block is in its upper trigger block position, the firearm's hammer can cause the firearm's firing pin to strike a cartridge in the firearm, and when the trigger block is in its lower trigger block position, hammer blocking means prevent the hammer from causing the firing pin to strike the cartridge. In a preferred embodiment, a rebounding hammer is employed and the hammer blocking means is a hammer blocking surface on the hammer, positioned to engage the block upper region when the trigger block is in its lower trigger block position.

10 Claims, 14 Drawing Sheets

SAFETY MECHANISM FOR SINGLE ACTION FIREARMS

FIELD OF THE INVENTION

The present invention relates to revolvers and other firearms having an external hammer, and in particular to an improved safety mechanism for such firearms.

BACKGROUND OF THE INVENTION

There are a variety of firearms which have an external hammer, including single action revolvers, which would benefit from an improved safety mechanism. These firearms are more fully enumerated in U.S. Pat. No. 3,777,384, incorporated herein by reference, which points out the deficiencies in the prior art safety mechanisms and notes that, classically, prior art firearms had a safe position where a safety notch of the hammer is engaged by the trigger. However, the '384 patent points out that a trigger-engaged safety notch is a weakness in the design of earlier single action firearms and can result in accidental discharge of the firearm if the hammer or trigger is accidentally struck when the firearm is in its presumably safe position.

The teaching of the '384 patent in part has overcome the problem of accidental firing of a firearm by employing a vertically disposed and movable trigger bar which is pivotably connected to the trigger. The vertically disposed and movable trigger bar moves from a lower position to an upper position when the hammer is cocked, the cocking of the hammer also advancing the trigger to a ready-to-fire position. When the vertically disposed and movable trigger bar is in the lower position, the firing pin cannot strike a cartridge loaded in the firearm, and when the vertically disposed and movable trigger bar is in the upper position, the firing pin can be advanced into the cartridge by the hammer, thereby firing the cartridge.

While the mechanism of the '384 patent will prevent accidental firing from the safety position, it requires substantial redesign of the mechanism and the resulting mechanism is not well suited for retrofitting into an existing firearm. Furthermore, the mechanism of the '384 patent is subject to accidental firing of the firearm when the hammer is in the cocked position.

Thus there is a need for a simpler safety mechanism which is more suitable to retrofitting and which provides a safety mechanism which will prevent accidental firing when the hammer is cocked.

SUMMARY OF THE INVENTION

The improved safety mechanism of the present invention is applicable to firearms which include the following interrelated elements: a frame; a hammer terminating in a base region and a striking region, the base region being pivotably mounted to the frame, the hammer being adapted to be manually moved from a hammer rest position to a hammer cocked position, and, when released from the hammer cocked position, rotating to a hammer fire position; a mainspring for biassing the hammer to rotate towards the hammer fire position; a trigger pivotably mounted to the frame below the hammer; a chamber mounted to the frame forward of the hammer and capable of housing a cartridge therein; and a firing pin which is associated with the hammer and mounted in a position to move forward to strike a cartridge housed in the chamber when the firearm is fired.

The firearm to which the present invention is to be incorporated has a hammer which cannot be moved to the hammer cocked position by pulling the trigger, but rather must be cocked against the bias of the mainspring either manually by the thumb of the user or, in the case of a repeating firearm, by operating the action of the firearm. The hammer has a sear notch positioned to engage a sear, which forms part of the trigger when the hammer is in the hammer cocked position. When the sear is engaged with the sear notch, the hammer is maintained in the hammer cocked position. When the trigger is moved to a hammer release position, the sear is released from engagement with the sear notch and the hammer is released from the hammer cocked position, allowing the hammer to rotate to the hammer fire position under the bias of the mainspring.

The trigger has a ready-to-fire position, where the sear is engaged with the sear notch of the hammer, at which time the hammer is in the hammer cocked position. When the sear and sear notch are thus engaged, the hammer is prevented from rotating under the bias of the mainspring. Trigger spring means are provided which bias the trigger against the pressure applied by the user. The trigger can be rotated by the user against the bias of the trigger spring means to the hammer release position, at which time the sear disengages from the sear notch, allowing the hammer to rotate under the bias of the mainspring towards the hammer fire position.

The present invention includes incorporating a safety channel in the frame of the firearm. A trigger block slidably engages the safety channel. The trigger block terminates in a block lower region and a block upper region. The block lower region is configured to slidably engage a block lower region engaging surface provided on the trigger such that rotation of the trigger from the ready-to-fire position to the hammer release position will move the trigger block from a lower trigger block position to an upper trigger block position. The block lower region engaging surface is preferably provided by the sear of the trigger. The block upper region is positioned relative to the hammer and firing pin such that the firing pin will strike and fire a cartridge when the trigger block is in the upper trigger block position and the hammer is released from the hammer cocked position and advances to the hammer fire position.

Means for biassing the trigger block towards the lower trigger block position are provided.

Hammer blocking means for engaging the hammer and preventing forward movement of the hammer and firing pin against a cartridge in the chamber when the trigger block is in its lower trigger block position are provided. The details of such means will, in part, depend on the details of the interconnection of the hammer and the firing pin.

In cases where the hammer makes direct contact with the firing pin when in the hammer fire position or the firing pin is an integral part of the hammer, a rebounding hammer is used and means are provided to maintain the hammer in the hammer rest position, which is positioned between the hammer fire position and the hammer cocked position. In one preferred embodiment, the rebounding hammer is provided by employing a spring loaded plunger which engages the hammer as the hammer approaches the hammer fire position and serves to provide a rebounding force to counter the force of the mainspring.

In an alternative preferred embodiment, the rebounding hammer is provided by a rebound mechanism which has a strut terminating in a strut base end and a strut fork end. A strut seat is mounted to the frame and the strut slidably engages the strut seat. Length L of the strut is greater than distance D between the hammer and the strut seat to ensure that the strut, at all times, is slidably engaged with the strut seat. The strut fork end has a first prong terminating in a first prong tip and a second prong terminating in a second prong tip. The strut passes through a coil spring which in turn engages the strut seat and the strut fork end. The coil spring in combination with the strut serves as the mainspring for the hammer. The hammer is provided with a fork slot which rockably engages the strut fork end. The fork slot is contoured to provide a first prong tip seat and a second prong tip seat. The first and second prong tip seats are so positioned that when the hammer is moved to the hammer cocked position, the first prong tip forcibly engages the first prong tip seat while the second prong tip is disengaged from the second prong tip seat. With the strut fork end so positioned, a compression load is applied to the coil spring. This compression load creates a torque on the hammer which rotates the hammer towards the hammer fire position when the sear of the trigger is disengaged from the sear notch. Conversely, when the hammer is in the hammer fire position, the second prong tip forcibly engages the second prong tip seat while the first prong tip is disengaged from the first prong tip seat. With the strut fork end so positioned, a compression load is again applied to the coil spring. This compression load creates a torque on the hammer which rotates the hammer away from the hammer fire position. When the hammer is in the hammer rest position, the first prong tip engages the first prong tip seat and the second prong tip engages the second prong tip seat and the forces on the two prong tip seats are such that there is no net torque on the hammer.

When a rebounding hammer is employed, the hammer blocking means is provided by a hammer blocking surface on the hammer which is positioned to engage the block upper region when the trigger block is in the lower trigger block position. It is further preferred that the hammer blocking surface be provided on the base region of the hammer.

In cases where the hammer is provided with a firing pin activation surface which does not make contact with the firing pin, a hammer stop is provided which can be affixed to either the frame or the hammer. The hammer stop assures separation of the firing pin activation surface from the firing pin. For such firearms where the hammer does not contact the firing pin, the transfer of the force from the hammer to the firing pin is provided via the block upper region of the trigger block. The block upper region is contoured to transmit the force from the firing pin activation surface of the hammer to the firing pin when the trigger block is in the upper trigger block position. It should be noted that in such cases, the hammer rest position may be the same as the hammer fire position.

BRIEF DESCRIPTION OF THE FIGURES

FIG. 12 illustrates the hammer in the hammer rest position. A hammer stop which is an integral part of the hammer is provided to maintain a separation between the firing pin activation surface and the firing pin.

BEST MODE OF CARRYING THE INVENTION INTO PRACTICE

Figure 1:
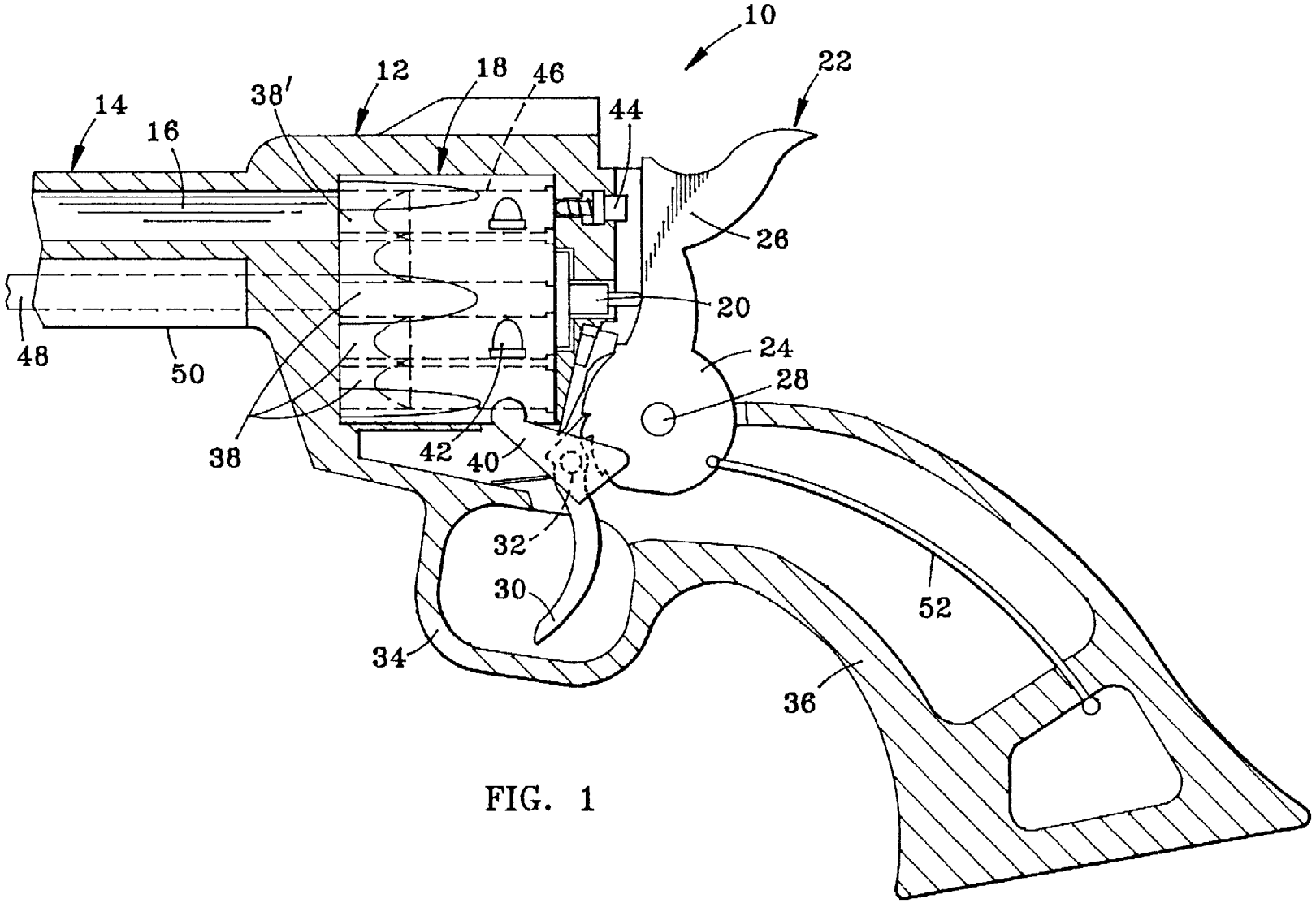
FIG. 1 illustrates the principal parts of a firearm which incorporates one embodiment of the present invention. In this embodiment, a hammer of the firearm rotates to a hammer fire position where it strikes a firing pin in order to fire a cartridge housed in the firearm. The hammer is illustrated in a hammer rest position where there is no contact between the firing pin and the hammer.

FIGS. 1 through 4 illustrate a single action revolver 10 which incorporates one embodiment of the improvement of the present invention. The single action revolver 10 has a frame 12 to which a barrel 14 having a bore 16 is attached. A cylinder 18 is rotatably mounted in the frame 12 on a cylinder pivot shaft 20. A hammer 22 having a base region 24 and a striking region 26 is pivotably mounted to the frame 12 with a hammer pivot pin 28 on which the base region 24 of the hammer 22 is rotatably mounted. The single action revolver 10 also has a trigger 30 pivotably mounted to the frame 12 with a trigger pivot pin 32. The frame 12 is also provided with a trigger guard 34 and a grip 36. The cylinder 18 in turn has a plurality of cartridge receiving chambers 38, each chamber 38 successively being maintained in alignment with the bore 16 of the barrel 14 when a pivotably mounted cylinder latch 40 successively engages cylinder notches 42 provided in the cylinder 18. A firing pin 44 is mounted in a position to strike a cartridge 46 contained in the chamber 38' which is maintained in alignment with the bore 16 of the barrel 14 when the revolver 10 is fired. In the embodiment of FIG. 1, the firing pin 44 is mounted in the frame 12 and slidably engaged therein. An ejector rod 48 is provided for ejecting spent cartridges from the chambers 38, the ejector rod 48 residing in an ejector rod housing 50 which in turn is mounted to the barrel 14. Although not shown for clarity, a pawl is typically employed for advancing the chambers 38 successively into alignment with the bore 16. The pawl is typically connected to the hammer 22 in a manner well known to those skilled in the art, U.S. Pat. No. 3,777,384 showing one example.

Figure 3:
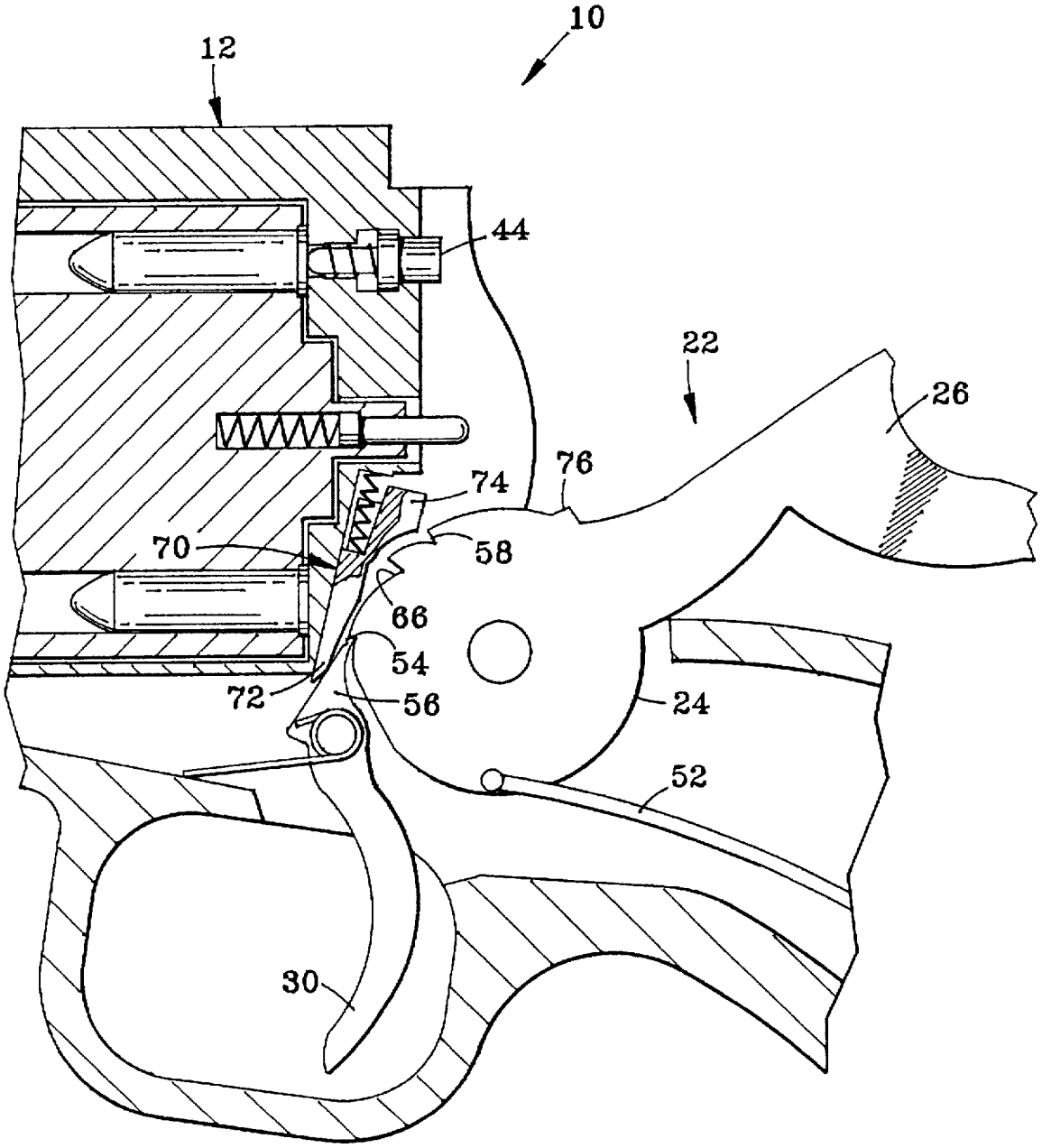
FIG. 3 illustrates the same embodiment as FIGS. 1 and 2; however, the hammer is in a hammer cocked position, where a sear of a trigger is engaged with a sear notch in the hammer, thereby maintaining the hammer in the hammer cocked position against the bias of a leaf spring provided which serves as a mainspring for rotating the hammer towards the hammer fire position. The trigger block is still in the lower trigger block position where a block upper region would engage a hammer blocking surface of the hammer if the hammer were to become disengaged with the sear.
Figure 4:
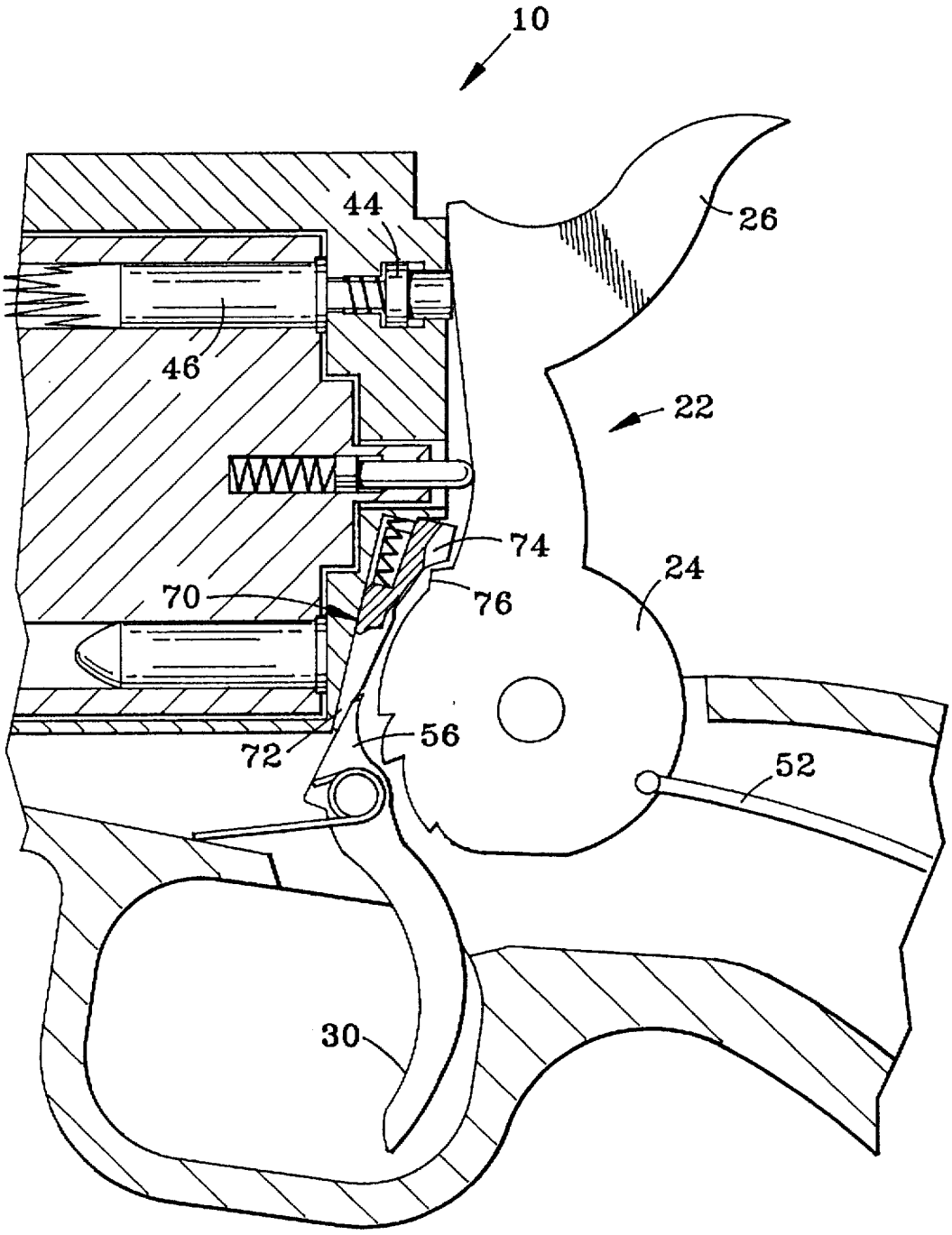
FIG. 4 illustrates the same embodiment as FIGS. 1 through 3, showing the trigger block in an upper trigger block position, where the block upper region passes above the hammer blocking surface, permitting the hammer to rotate to the hammer fire position and strike the firing pin. The spring loaded plunger is provided to rebound the hammer to the rest position of FIGS. 1 and 2.

The hammer 22 is designed to be manually moved from a hammer rest position (illustrated in FIGS. 1 and 2), to a hammer cocked position (illustrated in FIG. 3), and, when released from the hammer cocked position, rotates to a hammer fire position (illustrated in FIG. 4). A mainspring 52 is provided for biassing the hammer 22 to rotate towards the hammer fire position. In the single-action revolver 10, the mainspring 52 is a leaf spring which engages the frame 12 and the hammer 22. The hammer 22 cannot be moved from the hammer rest position (illustrated in FIGS. 1 and 2) to the hammer cocked position (illustrated in FIG. 3) by pulling the trigger 30, but rather must be cocked against the bias of the mainspring 52 manually by the thumb of the user.

Figure 2:
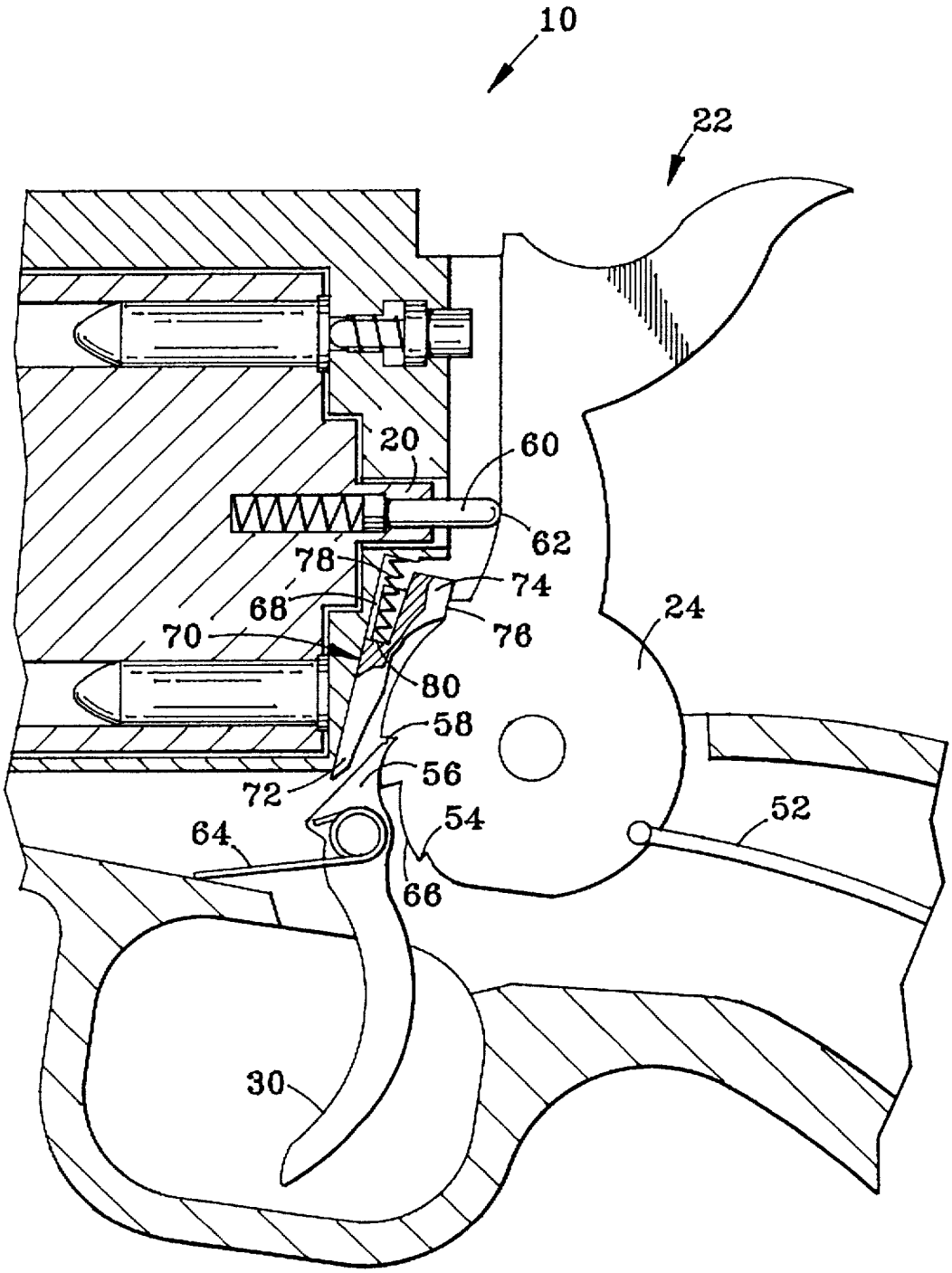
FIG. 2 is a detail view of the embodiment illustrated in FIG. 1. As shown, the hammer is maintained in the hammer rest position by a spring loaded plunger which engages the hammer to rotate the hammer away from the hammer fire position. A trigger block is provided which, when in a lower trigger block position as shown, blocks the hammer from advancing to the hammer fire position.

Referring to FIG. 2, the hammer 22 has a sear notch 54 on the base region 24 positioned to engage a sear 56, which forms part of the trigger 30, when the hammer 22 is in the hammer cocked position. The engagement of the sear 56 with the sear notch 54 prevents the hammer 22 from rotating under the bias of the mainspring 52. When the trigger 30 is moved by the user to a hammer release position (illustrated in FIG. 4), the sear 56 disengages from the sear notch 54 and the hammer 22 is allowed to rotate to the hammer fire position under the bias of the mainspring 52.

The hammer 22 also has a safety notch 58 on the base region 24 which is positioned to engage the sear 56 when the hammer 22 is in the hammer rest position. The safety notch 58, when engaged by the sear 56, prevents accidental firing caused by the hammer 22 being bumped; however, as noted in the '384 patent, a safety such as the safety notch 58 is subject to failure.

In the single-action revolver 10, a spring-loaded plunger 60 is mounted in the cylinder pivot shaft 20 and extends through the frame 12 so as to engage a plunger bearing surface 62 on the hammer 22 as the hammer 22 approaches the hammer fire position. The spring-loaded plunger 60 counters the biassing force of the mainspring 52, thereby providing a rebounding force to move the hammer 22 from the hammer fire position to the hammer rest position where the sear 56 engages the safety notch 58.

The trigger 30 has a trigger rest position (illustrated in FIGS. 1 and 2), a ready-to-fire position (illustrated in FIG. 3), and a hammer release position (illustrated in FIG. 4). The trigger 30 is biassed by a trigger spring 64. When the hammer 22 is in the hammer rest position, the bias of the trigger spring 64 pivots the trigger 30 to the trigger rest position where the sear 56 engages the safety notch 58 of the hammer 22. As the hammer 22 is moved to the hammer cocked position, a cam surface 66 on the base region 24 of the hammer 22 engages the trigger 30 and pivots it against the bias of the trigger spring 64. When the hammer 22 reaches the hammer cocked position, the cam surface 66 no longer engages the trigger 30, and the bias of the trigger spring 64 pivots the trigger 30 to the ready-to-fire position, where the sear 56 is engaged with the sear notch 54. The position of the trigger 30 in relation to the trigger guard 34 will depend on the configuration of the sear notch 54 and the safety notch 58. The trigger spring 64 also biasses the trigger 30 against any pressure applied by the user to pivot the trigger 30 from the ready-to-fire position to the hammer release position. When the trigger 30 is pivoted against the bias of the trigger spring 64 to the hammer release position, the sear 56 disengages from the sear notch 54, allowing the hammer 22 to rotate under the bias of the mainspring 52 towards the hammer fire position.

While the description of the mechanism above is for a Colt® single action revolver, it is substantially similar to the mechanism used in a Ruger® single action revolver such as described in the '384 patent, and principally differs in the details of the interaction between the hammer and trigger. The present invention, the discussion of which follows, is applicable to both the Ruger® and the Colt® single action revolvers, as well as other single action firearms.

The present invention provides a safety channel 68 in the frame 12 of the single action revolver 10. A trigger block 70 slidably engages the safety channel 68 and terminates in a block lower region 72 and a block upper region 74.

The block lower region 72 is configured to slidably engage the sear 56 which forms part of the trigger 30. It should be appreciated that the block lower region 72 could slidably engage the trigger 30 at a location other than the sear 56, particularly when the improvement of the present invention is employed in firearms where the configuration of the trigger is substantially different from that illustrated. The block lower region 72 is configured such that rotation of the trigger 30 from the ready-to-fire position to the hammer release position will cause the sear 56 to raise the trigger block 70 from a lower trigger block position (illustrated in FIGS. 1 through 3), to an upper trigger block position (illustrated in FIG. 4).

The block upper region 74 is configured such that it will engage a hammer blocking surface 76 provided on the base region 24 of the hammer 22 to prevent the hammer 22 from advancing to the hammer fire position (illustrated in FIG. 4) while the trigger block 70 is in the lower trigger block position (illustrated in FIGS. 1 through 3). In this embodiment, the block upper region 74 and the hammer blocking surface 76 provide hammer blocking means preventing rotation of the hammer 22, which in turn would drive the firing pin 44 against the cartridge 46 in the chamber 38', when the trigger block 70 is in its lower trigger block position. When the trigger 30 is rotated from the ready-to-fire position to the hammer release position, the trigger block 70 is moved to the upper trigger block position (illustrated in FIG. 4). In this position, the block upper region 74 is positioned such that, as the hammer 22 rotates towards the hammer fire position, the block upper region 74 clears the hammer blocking surface 76, allowing the hammer 22 to impact the firing pin 44 and drive it into the cartridge 46, thereby igniting the cartridge 46.

In the single-action revolver 10, a block-biassing spring 78 serves as the means for biassing the trigger block 70 towards the lower trigger block position (illustrated in FIGS. 1 through 3). The block-biassing spring 78 is a compression spring which resides in the safety channel 68 and engages the frame 12 and a spring-bearing surface 80 on the trigger block 70. When the hammer 22 is in the hammer rest position and the trigger 30 is in the trigger rest position (illustrated in FIGS. 1 and 2), the compressive load on the block-biassing spring 78 biasses the trigger block 70 to the lower trigger block position.

In this embodiment, the lower trigger block position is defined by the engagement of the block upper region 74 with the base region 24 of the hammer 22 (illustrated in FIG. 2). It should be appreciated that the lower trigger block position could be defined by alternative means for limiting the downward extent of motion of the trigger block. Such means would include a slot-and-pin connection between the trigger block and the frame, or a fixably attached block-biassing spring which is at equilibrium when the trigger block is in the lower trigger block position.

Figure 5:
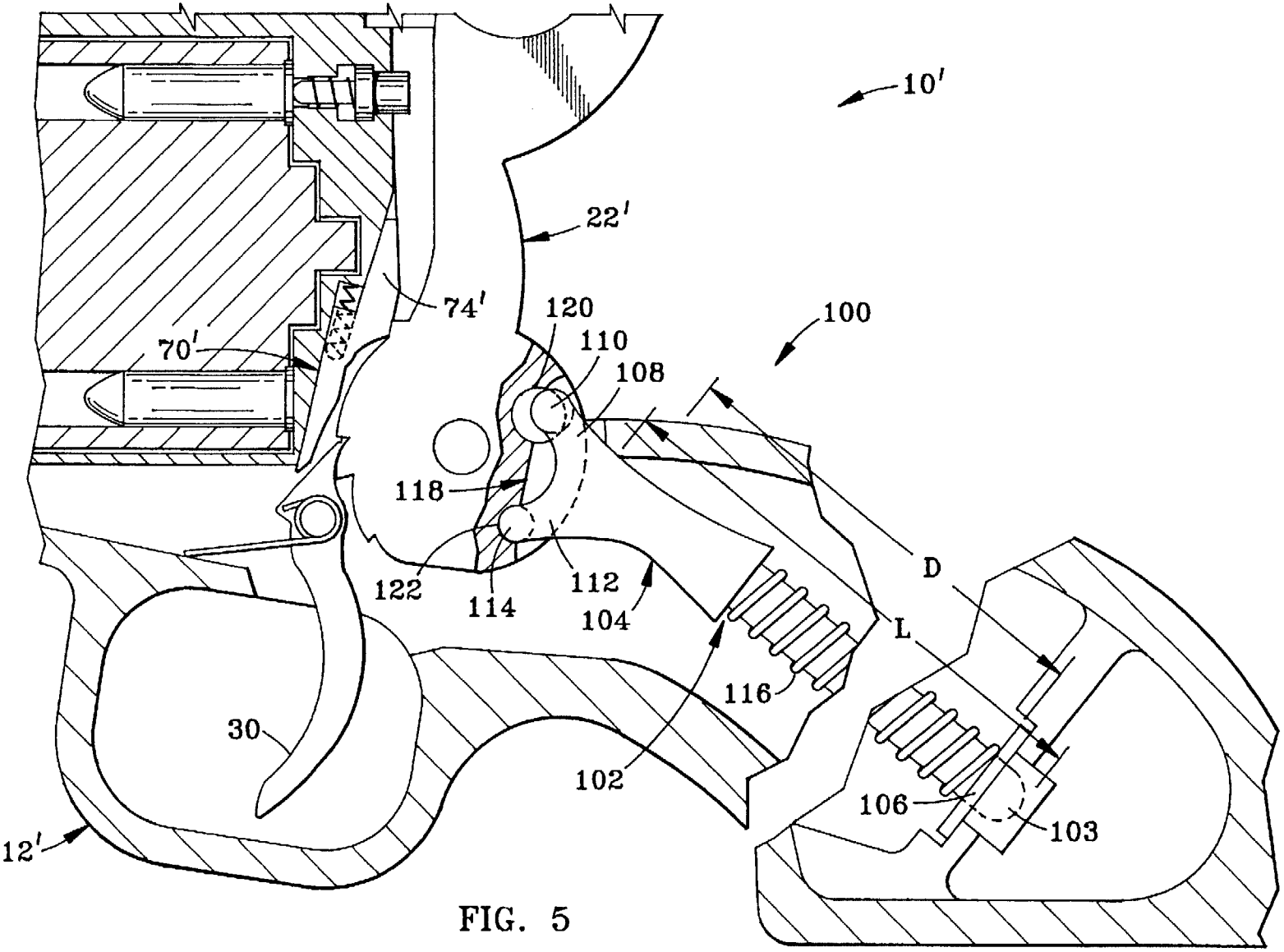
FIG. 5 illustrates a second embodiment of the present invention which employs the same safety mechanism as employed in the embodiment illustrated in FIGS. 1–4. In this embodiment, a different hammer rebound mechanism is employed. A strut is provided which terminates in a strut base end and a strut fork end, the strut fork end having a first prong terminating in a first prong tip and a second prong terminating in a second prong tip. The strut slidably engages a strut seat which in turn is affixed to the frame of the firearm. The strut passes through a coil spring which rests on the strut seat and biasses the strut fork end towards the hammer. The hammer of this embodiment is provided with a fork slot which rockably engages the strut fork end. The fork slot is configured to provide a first prong tip seat and a second prong tip seat, the first and second prong tip seats being positioned to respectively engage the first and second prong tips when the hammer is in the rest position as illustrated in FIG. 5, and when so positioned results in no net torque being applied to the hammer.
Figure 6:
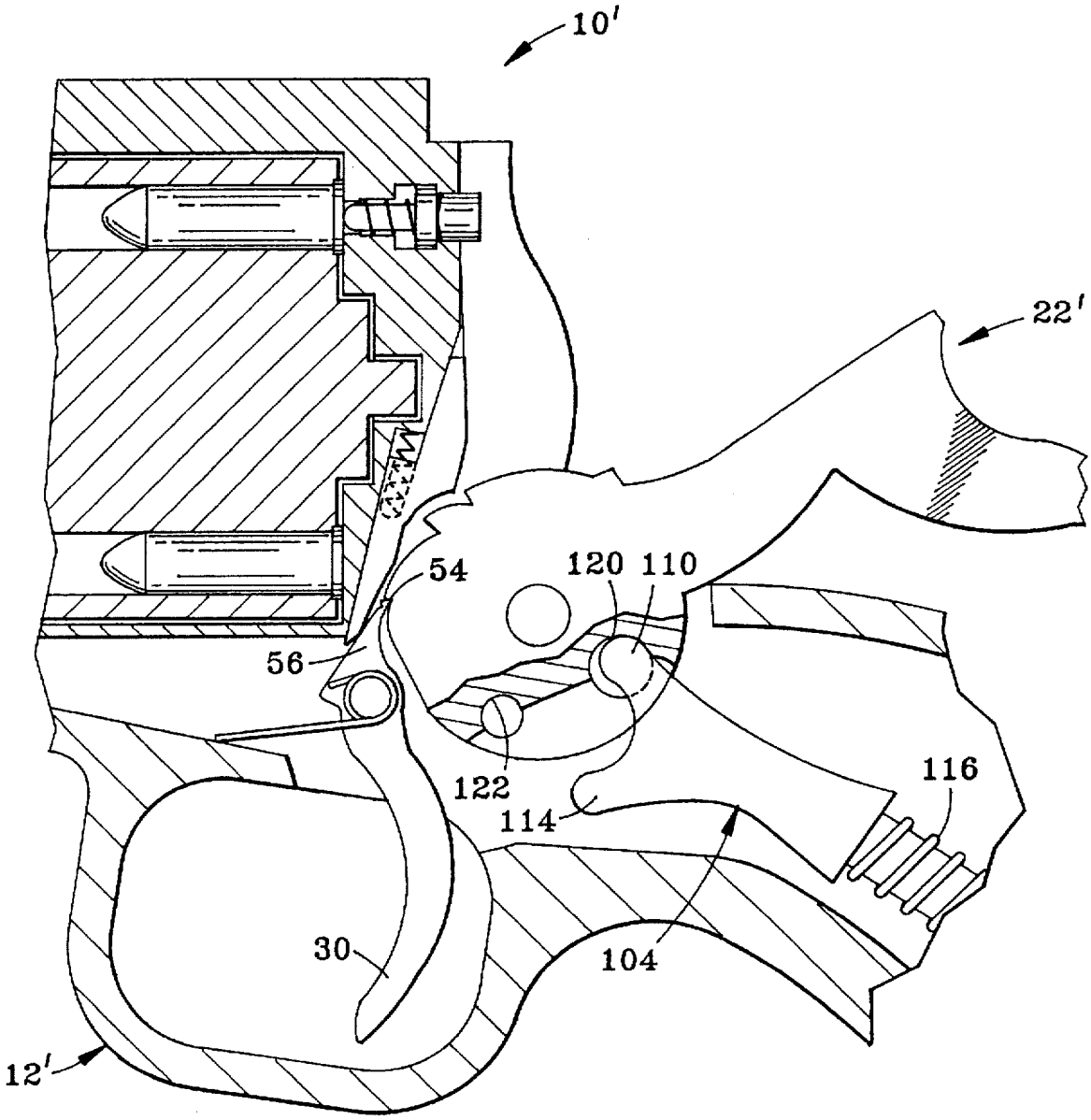
FIG. 6 illustrates the embodiment of FIG. 5 where the hammer is in the hammer cocked position. In this position, the first prong tip forcibly engages the first prong tip seat while the second prong tip is disengaged from the second prong tip seat, thereby providing a torque which will rotate the hammer towards the hammer fire position when the sear is disengaged from the sear notch.
Figure 7:
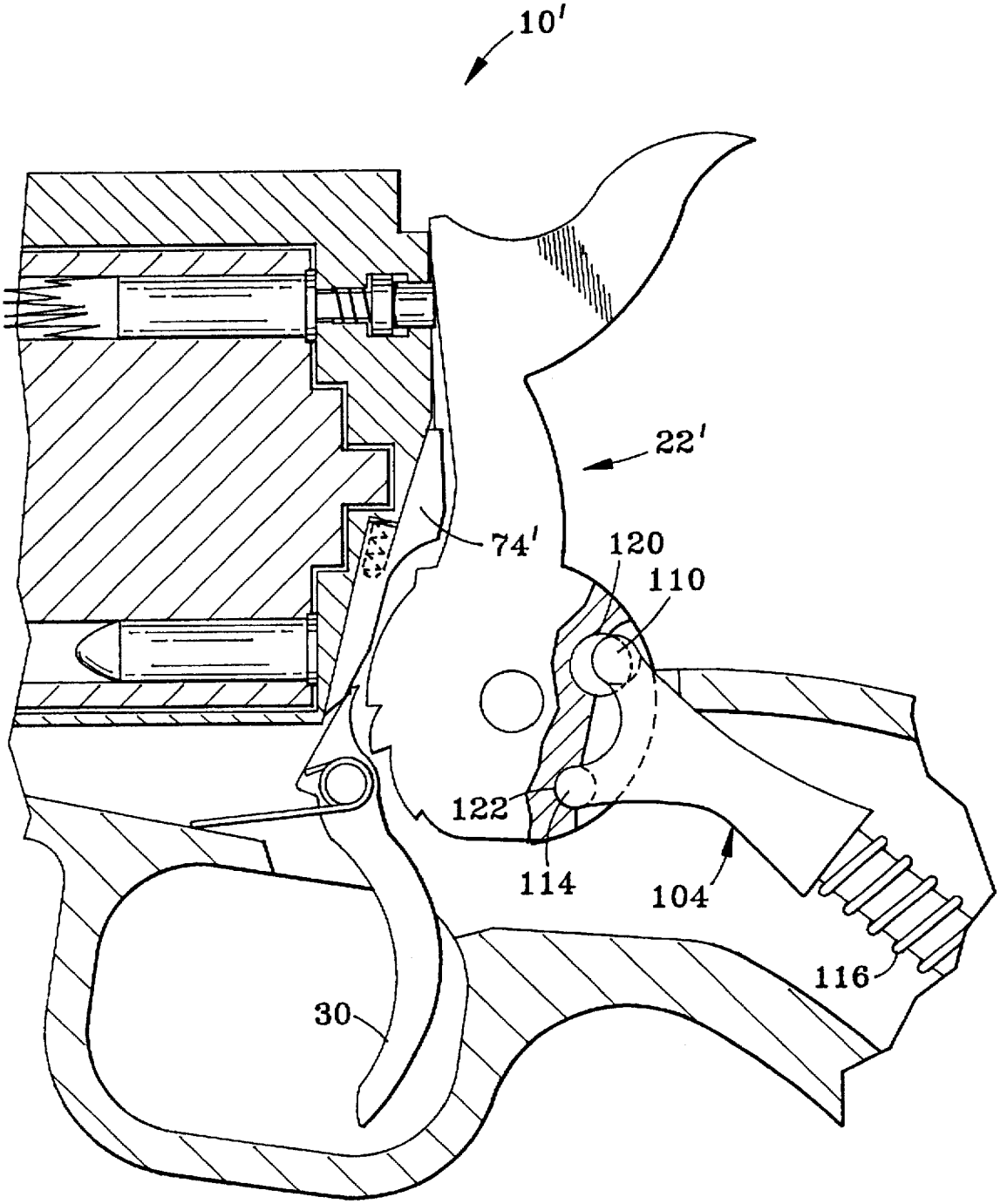
FIG. 7 illustrates the embodiment of FIGS. 5 and 6 where the hammer is in the hammer fire position. In this position, the second prong tip forcibly engages the second prong tip seat while the first prong tip is disengaged from the first prong tip seat, thereby providing a torque to rotate the hammer away from the hammer fire position.

FIGS. 5 through 7 illustrate a single-action revolver 10' which is an embodiment closely related to the embodiment illustrated in FIGS. 1 through 4. The single-action revolver 10' differs from the single action revolver 10 illustrated in FIGS. 1 through 4 in that the single-action revolver 10' has a rebound mechanism 100 to move the hammer 22' from the hammer fire position (illustrated in FIG. 7) to the hammer rest position (illustrated in FIG. 5). The rebound mechanism 100 is an integral part of the hammer biassing means used to advance the hammer 22' to the hammer fire position. The rebound mechanism 100 has a strut 102 having a length L and terminating in a strut base end 103 and a strut fork end 104. A strut seat 106 is mounted to the frame 12' and the strut 102 slidably engages the strut seat 106. The length L of the strut 102 is somewhat greater than a distance D from the hammer 22' to the strut seat 106 to assure that the strut base end 103 will remain slidably engaged with the strut seat 106.

The strut fork end 104 has a first prong 108 terminating in a first prong tip 110 and a second prong 112 terminating in a second prong tip 114. The strut 102 passes through a coil spring 116 which in turn engages the strut seat 106 and the strut fork end 104. The strut 102 and the coil spring 116, in combination, perform the function of a mainspring for the hammer 22' and replace the mainspring 52 employed with the hammer 22 of the revolver 10 illustrated in FIGS. 1 through 4. The hammer 22' is similar to the hammer 22, differing in that the hammer 22' is provided with a fork slot 118 which rockably engages the strut fork end 104. The fork slot 118 is contoured to provide a first prong tip seat 120, positioned to be engaged by the first prong tip 110, and a second prong tip seat 122, positioned to be engaged by the second prong tip 114.

Because the single action revolver 10' does not have a spring-loaded plunger such as the spring-loaded plunger 60 of the revolver 10 illustrated in FIGS. 1 through 4, the trigger block 70' can be provided with an extended block upper region 74'. The extended block upper region 74' provides greater stability to the trigger block 70' as it moves between its lower and upper trigger block positions.

FIG. 5 illustrates the single-action revolver 10' when the hammer 22' is in the hammer rest position. In this position, the first prong tip 110 engages the first prong tip seat 120 and the second prong tip 114 engages the second prong tip seat 122, both applying forces due to the compression of the coil spring 116 between the strut seat 106 and the strut fork end 104. When the hammer 22' is in the hammer rest position, the forces on the two prong tip seats (120 and 122) are such that there is no net torque on the hammer 22', and it is maintained in the hammer rest position.

When the hammer 22' is moved by the user to the hammer cocked position (illustrated in FIG. 6), the first prong tip 110 forcibly engages the first prong tip seat 120 while the second prong tip 114 is disengaged from the second prong tip seat 122. With the strut fork end 104 so positioned, a compression load is applied to the coil spring 116 which creates a torque on the hammer 22' which biasses the hammer 22' to rotate towards the hammer fire position (illustrated in FIG. 7). In the hammer cocked position, the engagement of the sear 56 of the trigger 30 with the sear notch 54 maintains the hammer 22' in the hammer cocked position. When the sear 56 is disengaged from the sear notch 54, the hammer 22' will rotate under the bias of the coil spring 116 towards the hammer fire position. At the point where the hammer 22' reaches the hammer rest position, it will have gained sufficient momentum to be carried to the hammer fire position.

FIG. 7 illustrates the hammer 22' when it has reached the hammer fire position. In this position, the second prong tip 114 forcibly engages the second prong tip seat 122 while the first prong tip 110 is disengaged from the first prong tip seat 120. With the strut fork end 104 so positioned, a compression load is again applied to the coil spring 116. This compression load creates a torque on the hammer 22' which rotates the hammer 22' away from the hammer fire position to the hammer rest position.

Figure 8:
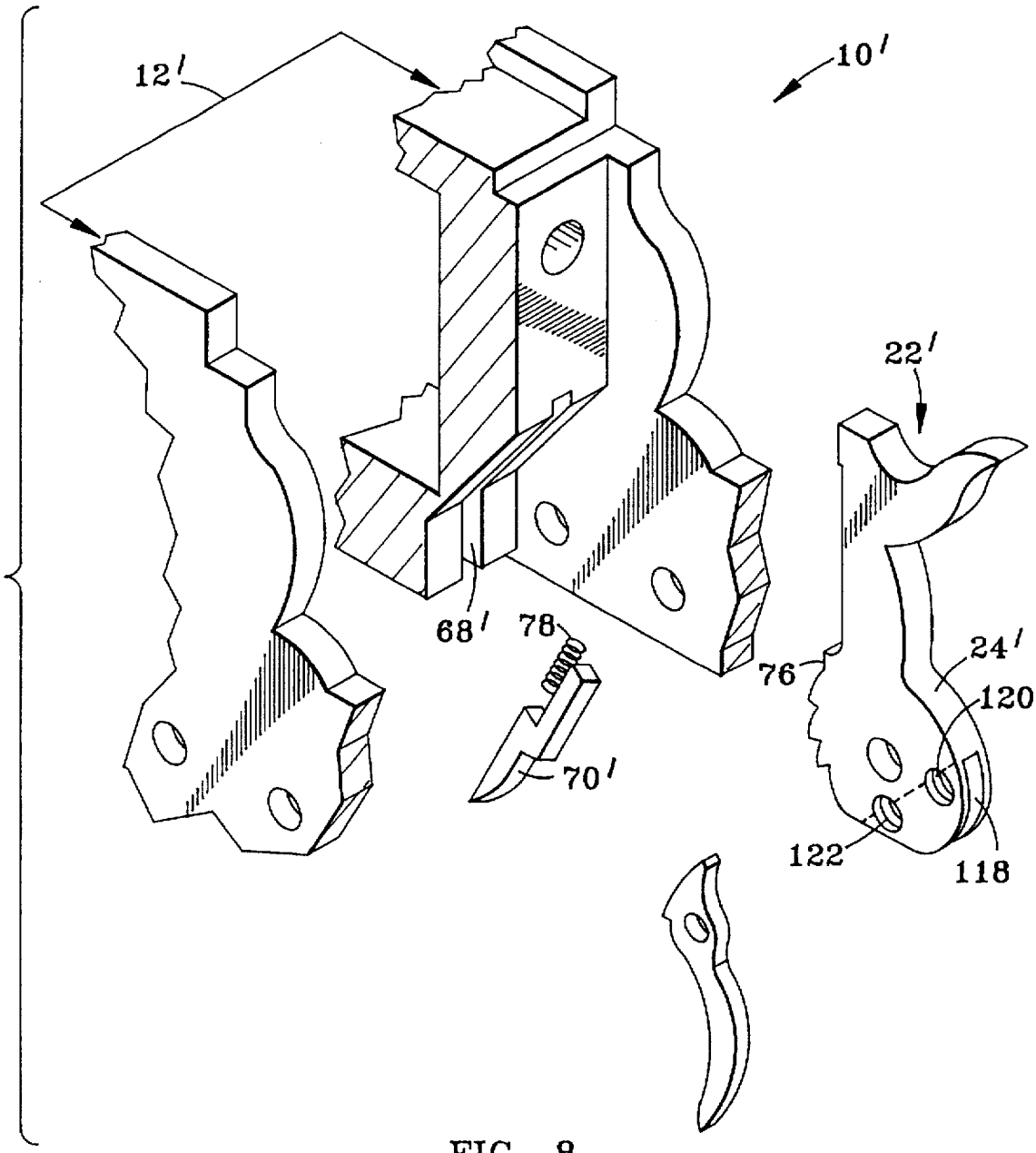
FIG. 8 is an exploded isometric view of the hammer—frame—trigger region of the embodiment of FIGS. 5 through 7, illustrating the modifications required to convert an existing single action mechanism to include the safety of the present invention. A fork slot and a hammer blocking surface are provided to a base region of the hammer, while a safety channel is provided in the frame.

FIG. 8 is an exploded isometric view of the hammer—frame—trigger region of the single action revolver 10' (illustrated in FIGS. 5 through 7) which illustrates the modifications which are required to the frame 12' and the hammer 22' to convert an existing single action mechanism, such as that of the well-known Colt® Peacemaker® revolver, to include the safety of the present invention. In this embodiment, the strut fork end 104 and the coil spring 116 (illustrated in FIGS. 5 through 7) replace a leaf-type main spring of the Colt® Peacemaker® revolver such as illustrated in the embodiment of FIGS. 1 through 4. This strut fork end 104 requires providing the fork slot 118 in the base region 24' of the hammer 22'. The fork slot 118 can be readily provided as a modification to the Colt® Peacemaker® hammer by drilling holes in the base region 24' of the hammer 22' to form the first and second prong tip seats (120 and 122) and cutting the remainder of the fork slot 118 into the base region 24'.

In the single action revolver 10', the original Colt® Peacemaker® hammer is also modified by providing the base region 24' of the hammer 22' with the hammer blocking surface 76, which can be provided by cutting a notch into the base region 24' of the hammer 22'.

The only other modification that need be made to the Colt® Peacemaker® revolver is the incorporation of the safety channel 68' into the frame 12'. Again, such can readily be provided by cutting the safety channel 68' into the frame 12'.

With these modifications of a Colt® Peacemaker® revolver, the trigger block 70' and the block-biassing spring 78 can be inserted into the frame 12' to provide a modified Colt® Peacemaker® revolver which now has the improved safety mechanism of the present invention. These simple changes required make the present invention readily suited to retrofitting to an existing revolver having a mechanism such as that of the Colt® Peacemaker®.

Figure 9:
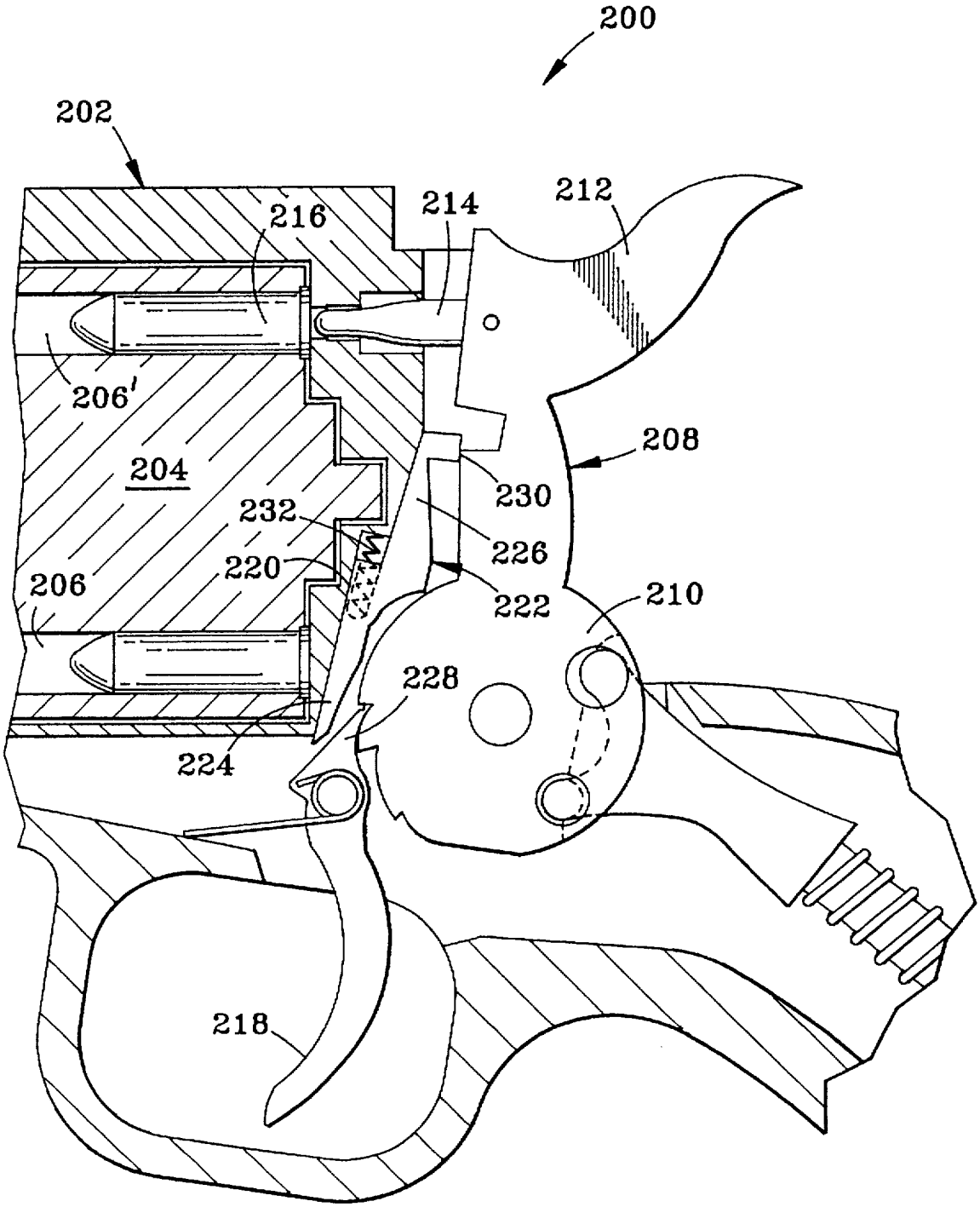
FIGS. 9–11 illustrate another embodiment of the present invention which is similar to the embodiment of FIGS. 5–8. This embodiment differs in that the hammer and firing pin are an integral unit and in that an alternate position for the hammer blocking surface on the hammer is provided which in turn requires a different configuration of the block upper region of the trigger block.
Figure 10:
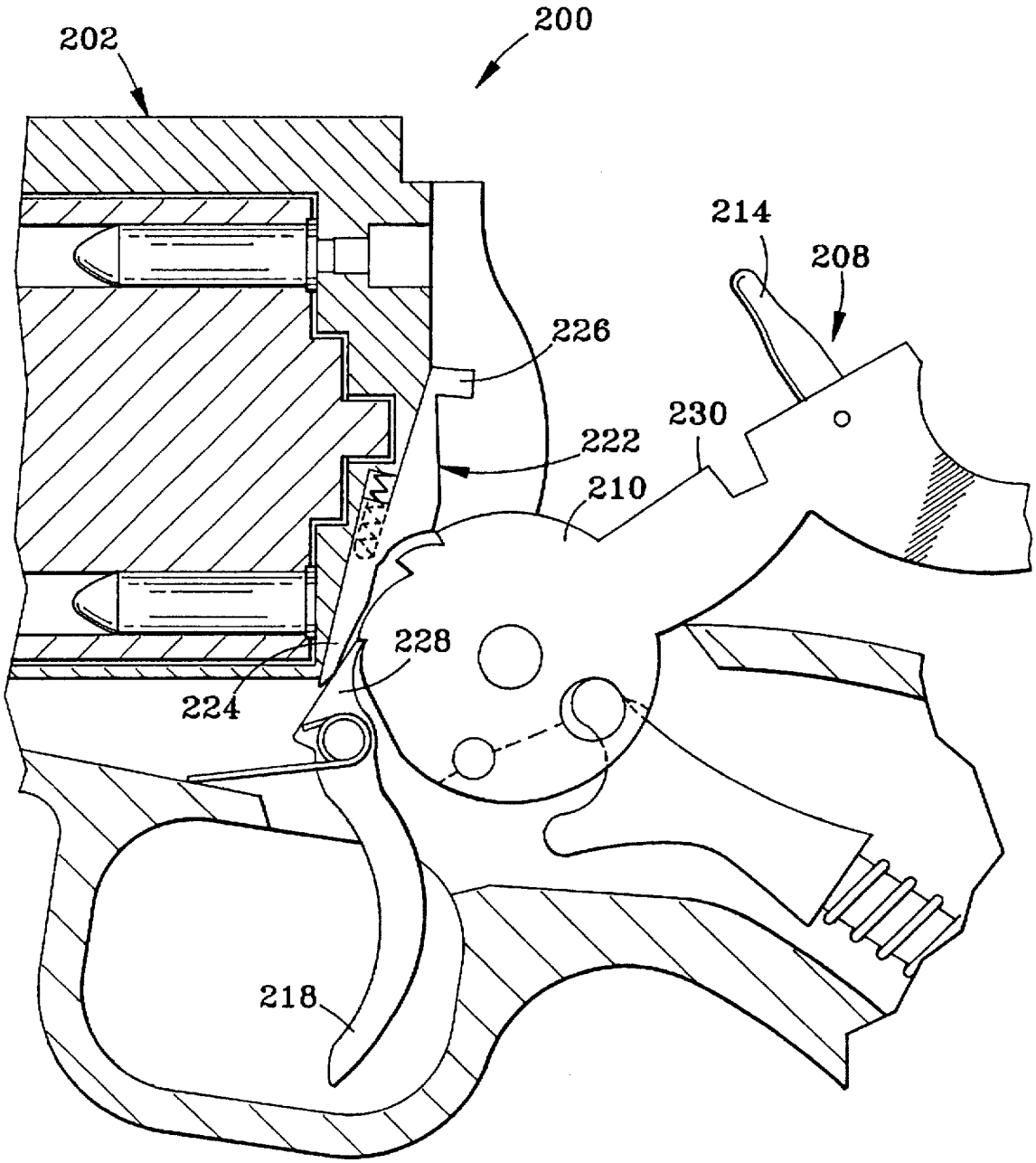
Figure 11:
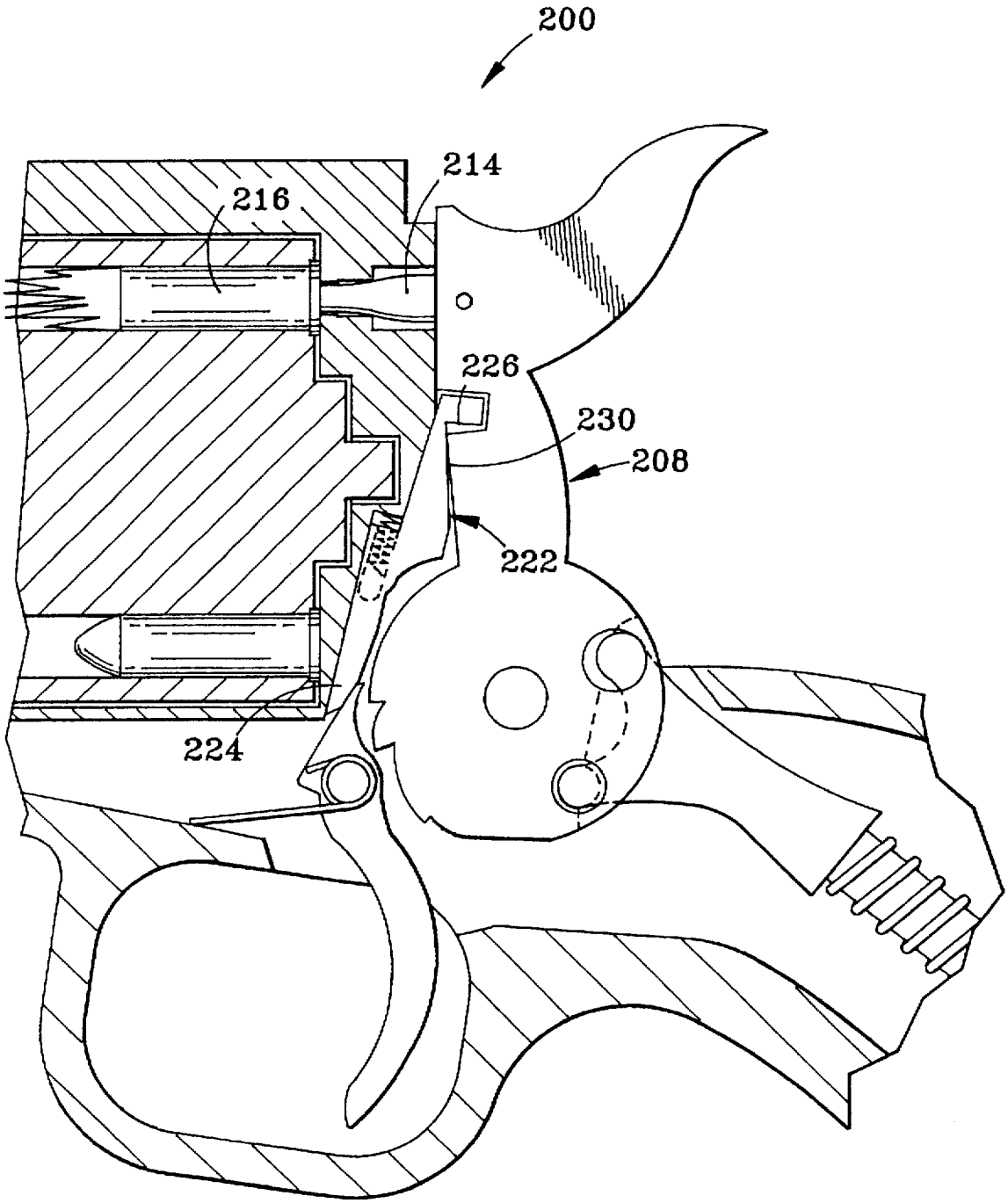

FIGS. 9 through 11 illustrate a single-action revolver 200 which incorporates another embodiment of the present invention. The single-action revolver 200 has a frame 202, and a cylinder 204 rotatably mounted to the frame 202. The cylinder 204 has a plurality of cartridge receiving chambers 206. A hammer 208 is provided which has a base region 210 pivotably mounted to the frame 202 and a striking region 212. A firing pin 214 is mounted to the striking region 212 of the hammer 208 in a position to strike a cartridge 216 contained in the chamber 206'. A trigger 218 is pivotably mounted to the frame 202.

The hammer 208 again has a hammer rest position (illustrated in FIG. 9), a hammer cocked position (illustrated in FIG. 10), and a hammer fire position (illustrated in FIG. 11). The hammer 208 and trigger 218 function in the same manner as the hammer 22 and trigger 30 of the embodiment of FIGS. 1 through 4.

The single action revolver 200 has a safety channel 220 in the frame 202 and a trigger block 222 which slidably engages the safety channel 220 and terminates in a block lower region 224 and a block upper region 226. The block lower region 224 is again configured to slidably engage a sear 228 of the trigger 218 such that rotation of the trigger 218 from the ready-to-fire position to the hammer release position will cause the sear 228 to raise the trigger block 222 from a lower trigger block position (illustrated in FIGS. 9 and 10), to an upper trigger block position (illustrated in FIG. 11). The block upper region 226 is configured such that it will engage a hammer blocking surface 230 provided on the hammer 208. The hammer blocking surface 230 is provided on the striking region 212 of the hammer 208, and serves to prevent the hammer 208 from advancing to the hammer fire position (illustrated in FIG. 11) while the trigger block 222 is in the lower trigger block position.

When the trigger 218 is rotated from the ready-to-fire position (illustrated in FIG. 10) to the hammer release position (illustrated in FIG. 11), the trigger block 222 is moved to the upper trigger block position where the block upper region 226 is positioned such that the block upper region 226 clears the hammer blocking surface 230, allowing the hammer 208 to rotate to the hammer fire position, driving the firing pin 214 into the cartridge 216, thereby igniting the cartridge 216.

Again, a block-biassing spring 232 serves to bias the trigger block 222 towards the lower trigger block position when the hammer 208 is in the hammer rest position and the trigger 218 is in the trigger rest position.

Figure 12:
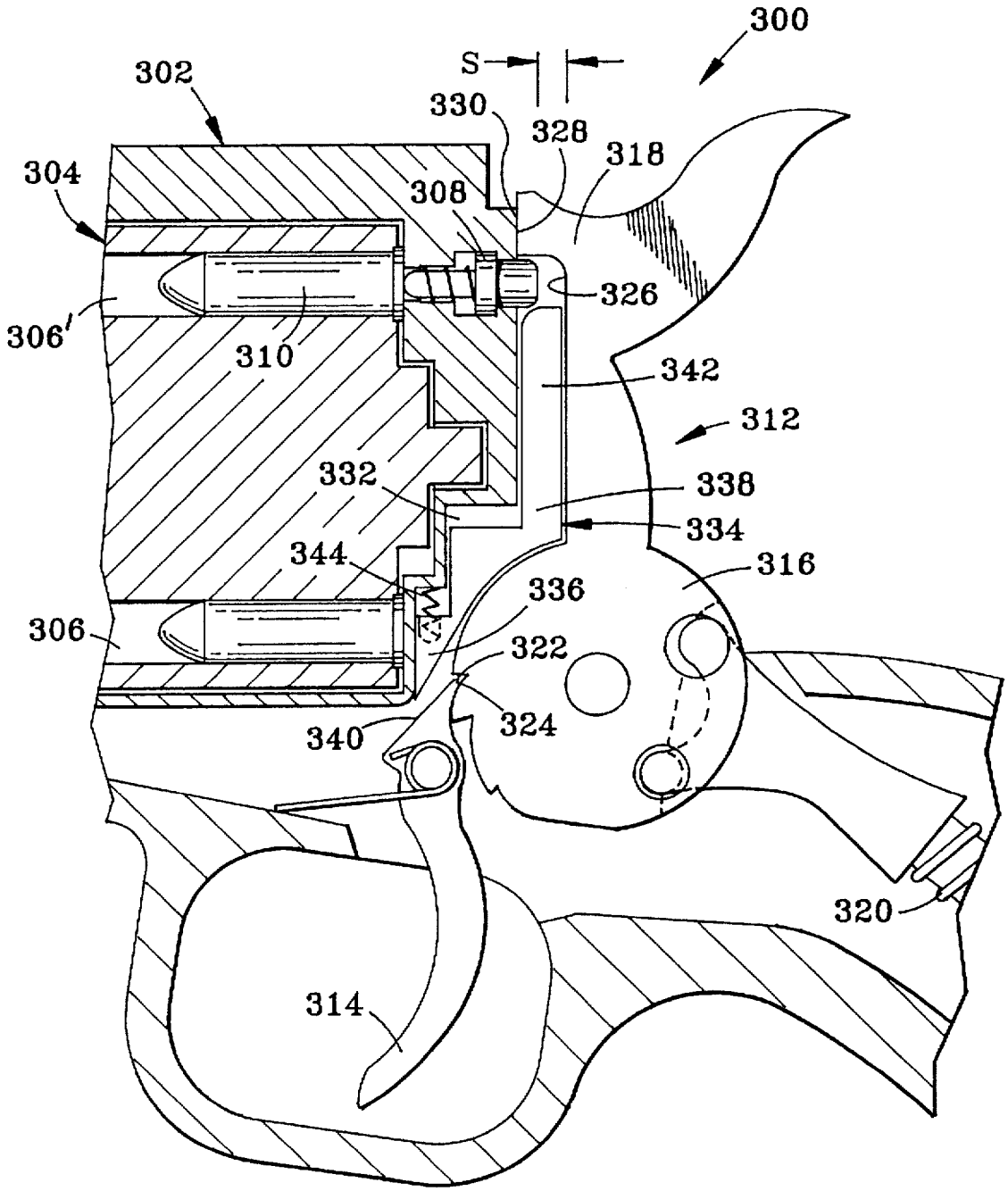
FIG. 12 illustrates an embodiment of the present invention where the hammer has a firing pin activation surface which does not contact the firing pin.
Figure 13:
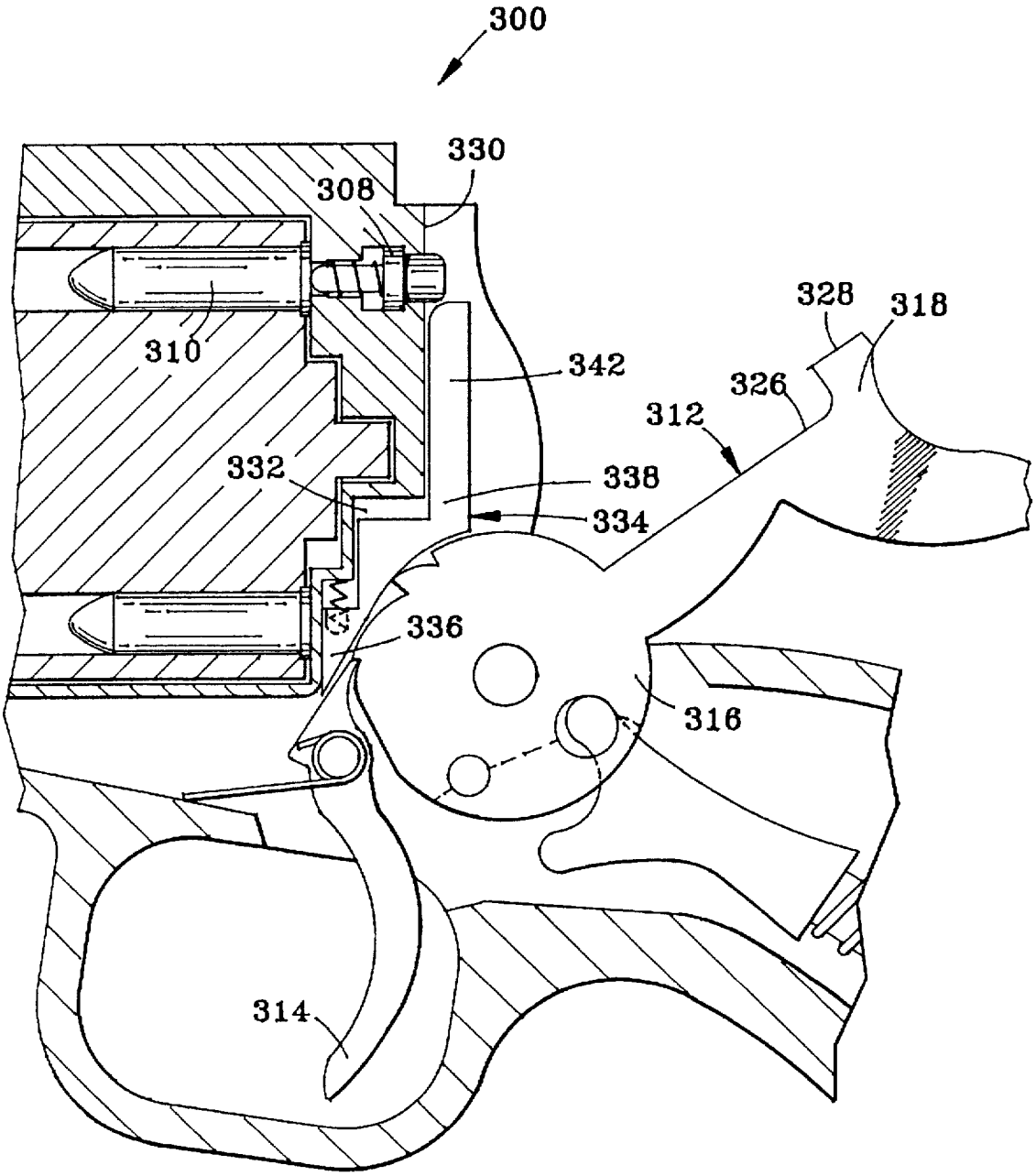
FIG. 13 illustrates the embodiment of FIG. 12 where the hammer is in the hammer cocked position.
Figure 14:
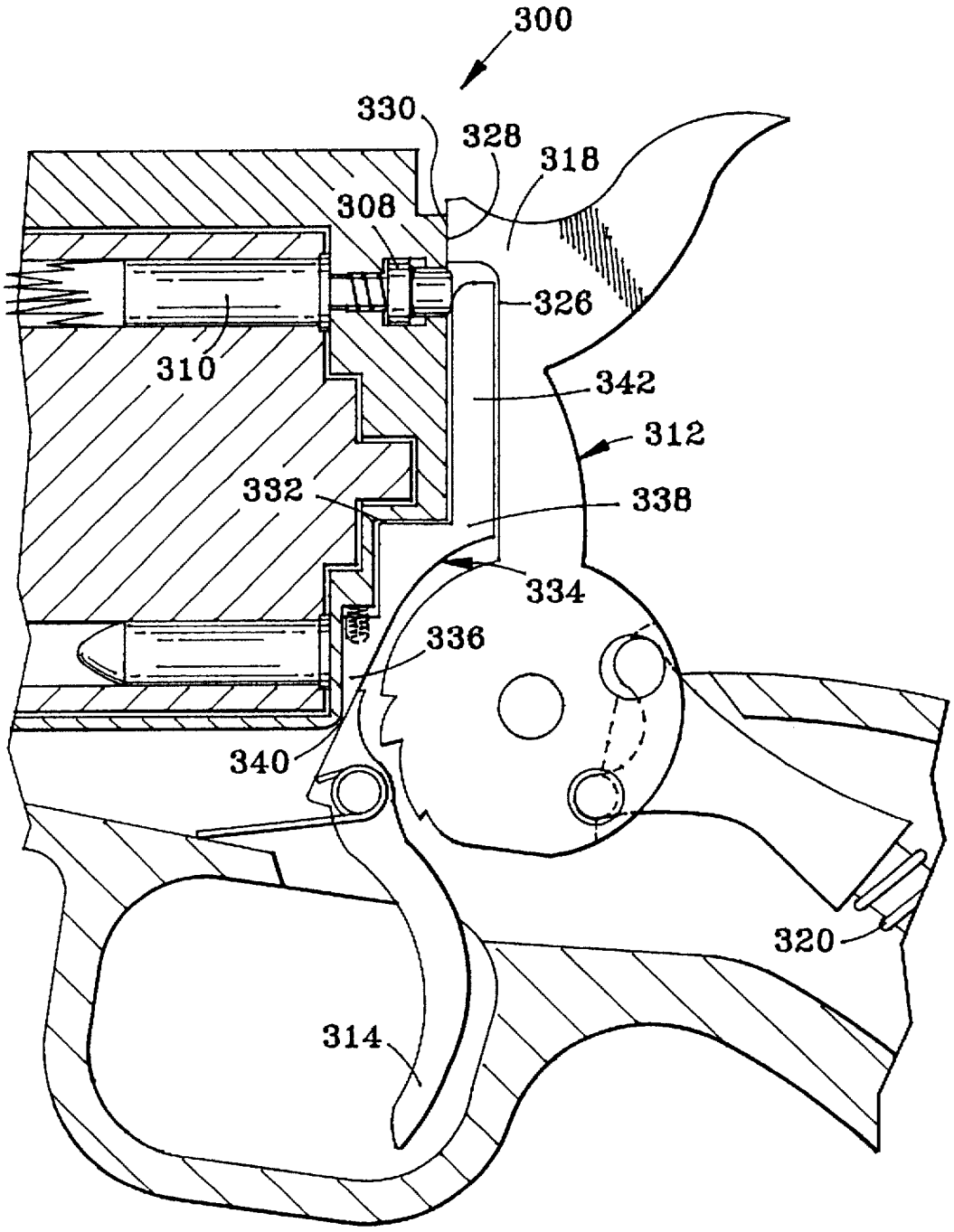
FIG. 14 illustrates the embodiment of FIGS. 12 and 13 where the hammer is in the hammer fire position. The hammer stop engages the firearm frame to maintain a separation between the firing pin activation surface and the firing pin. When the trigger block is in the upper trigger block position, the block upper region is interposed between the firing pin activation surface of the hammer and the firing pin, allowing the force of the hammer to be transferred to the firing pin.

FIGS. 12 through 14 illustrate a single-action revolver 300 which incorporates another embodiment of the present invention. The single-action revolver 300 has a frame 302, and a cylinder 304 rotatably mounted to the frame 302. The cylinder 304 has a plurality of cartridge receiving chambers 306. A firing pin 308 is mounted in the frame 302 and positioned to strike a cartridge 310 contained in the chamber 306'. A hammer 312 and a trigger 314 are pivotably mounted to the frame 302.

The hammer 312 again has a base region 316 and a striking region 318, and is designed to be manually moved from a hammer rest position (illustrated in FIG. 12), to a hammer cocked position (illustrated in FIG. 13), and, when released from the hammer cocked position, rotates to a hammer fire position (illustrated in FIG. 14) under the bias of a mainspring 320. It should be noted that in the single-action revolver 300, the hammer rest position is the same as the hammer fire position, and hereafter will be referred to as the hammer rest/fire position. The hammer 312 has a sear notch 322 on the base region 316 positioned to engage a sear 324 which forms part of the trigger 314 in the same manner as the sear notch 54 and sear 56 of the embodiment of FIGS. 1 through 4.

The hammer 312 is provided with a firing pin activation surface 326 and a hammer stop 328 on the striking region 318 of the hammer 312. The hammer stop 328 engages a hammer stop bearing surface 330 provided on the frame 302 when the hammer 312 is in the hammer rest/fire position. It should be appreciated that the hammer stop 328 could alternatively be provided on the frame 302, in which case the hammer stop bearing surface 330 is provided on the hammer 312. The engagement of the hammer stop 328 with the hammer stop bearing surface 330 maintains the firing pin activation surface 326 separated from the firing pin 308 by a separation S.

The trigger 314 again has a trigger rest position (illustrated in FIG. 12), a ready-to-fire position (illustrated in FIG. 13), and a hammer release position (illustrated in FIG. 14). The action of the trigger 314 is similar to the action of the trigger 30 described previously for the embodiment of FIGS. 1 through 4.

The frame 302 is again provided with a safety channel 332, which, in this embodiment, is substantially vertical. The safety channel 332 is slidably engaged by a trigger block 334, which in turn terminates in a block lower region 336 and a block upper region 338. The block lower region 336 is configured to slidably engage a block lower region engaging surface 340 provided on the trigger 314 such that rotation of the trigger 314 to the hammer release position will cause the trigger block 334 to move from a lower trigger block position (illustrated in FIGS. 12 and 13), to an upper trigger block position (illustrated in FIG. 14).

The block upper region 338 of this embodiment differs in that the block upper region 338 is configured to provide a transfer bar 342. The transfer bar 342 is positioned to be interposed between the firing pin activation surface 326 and the firing pin 308 when the trigger block 334 is in the upper trigger block position, and contoured to transmit the force from the firing pin activation surface 326 of the hammer 312 to the firing pin 308 when the hammer 312 rotates from the hammer cocked position to the hammer fire/rest position. When the trigger block 334 is in the lower trigger block position (illustrated in FIGS. 12 and 13), the transfer bar 342 resides below the firing pin 308, and thus is not interposed between the firing pin activation surface 326 and the firing pin 308. There is provision for some free play between the trigger block 334 and the safety channel 332 to allow the transfer bar 342 to be raised past the firing pin 308 when the trigger block 334 moves from the lower trigger block position to the upper trigger block position.

Alternatively, a transfer bar could be provided which is pivotably attached to the block upper region 338, the pivotable attachment allowing the transfer bar 342 to be raised past the firing pin 308. In such cases, means should be provided to limit the pivoting motion of the transfer bar 342 relative to the block upper region 338 to assure that the transfer bar 342 does not pivot so far towards the hammer 312 when the hammer 312 is in the hammer cocked position that the transfer bar 342 can become jammed between the hammer 312 and the frame 302 when the hammer 312 is released.

Means for biassing the trigger block 334 towards the lower trigger block position are again provided by a block-biassing spring 344.

While the novel features of the present invention have been described in terms of particular embodiments and preferred applications, it should be appreciated by one skilled in the art that substitution of materials and modification of details obviously can be made without departing from the spirit of the invention. Particularly, although a single action revolver is used to illustrate the improvement of the present invention, it should be appreciated that the improvement has utility for other firearms having manually cocked hammers. Examples of such firearms are break-open shotguns and rifles and lever or pump action rifles which have external hammers.

What I claim is:

1. A safety mechanism for a firearm having;

a frame, an external pivotably mounted hammer having a base region pivotably mounted to the frame, the hammer being manually rotatable from a hammer rest position to a hammer cocked position and, when released from the hammer cocked position, rotating towards a hammer fire position, a means for biassing the hammer, when released from the hammer cocked position, to rotate towards the hammer fire position, a sear notch in the hammer, a trigger pivotably mounted below the hammer, the trigger being moveable from a trigger ready-to-fire position to a hammer release position, a sear on the trigger which engages the sear notch of the hammer when the trigger is in the ready-to-fire position and the hammer is in the hammer cocked position and becomes disengaged from the sear notch when the trigger is rotated to the hammer release position, the sear preventing the hammer from rotating to the hammer fire position when the sear is engaged with the sear notch, a trigger biassing means which biasses the trigger such that the sear will be urged into engagement with the sear notch when the hammer is moved to the hammer cocked position, a cartridge-receiving chamber in front of the hammer, and a firing pin associated with the hammer and mounted in a position to strike and fire a cartridge in the cartridge-receiving chamber in front of the hammer, the safety mechanism comprising:

a safety channel in the frame;

a trigger block configured to slidably engage said safety channel as it moves between a lower trigger block position and an upper trigger block position, said trigger block having a block upper region and a block lower region;

a block lower region engaging surface provided on the trigger, said block lower region of said trigger block being configured to slidably engage said block lower region engaging surface of the trigger and so configured as to raise said trigger block from said lower trigger block position to said upper trigger block position as the trigger is rotated from the trigger ready-to-fire position to the hammer release position;

means for biassing said trigger block towards said lower trigger block position; and hammer blocking means engaging the hammer and preventing forward movement of the hammer and firing pin against a cartridge in the chamber when said trigger block is in said lower trigger block position, said block upper region of said trigger block being positioned with respect to the hammer so that the hammer will cause the firing pin to strike and fire the cartridge in the chamber when said trigger block is in said upper trigger block position.

2. The safety mechanism of claim 1 wherein the safety mechanism further comprises means for maintaining the hammer in a hammer rebound position which is between the hammer fire position and the hammer cocked position and serves as the hammer rest position and further wherein said hammer blocking means further comprises:

a hammer blocking surface on the hammer, said hammer blocking surface being positioned such that, when said trigger block is in said lower trigger block position, said hammer blocking surface will engage said block upper region when the hammer approaches the hammer fire position, said engagement of said hammer blocking surface with said block upper region preventing the hammer from rotating to the hammer fire position.

3. The safety mechanism of claim 2 wherein said hammer blocking surface resides on the base region of the hammer.

4. The safety mechanism of claim 3 wherein said means for biassing said trigger block towards said lower trigger block position when the hammer is in the hammer rest position further comprises:

a compression spring which engages the frame and said trigger block and which is compressed as said trigger block is moved from said lower trigger block position to said upper trigger block position.

5. The safety mechanism of claim 4 wherein said block lower region engaging surface is provided by the sear of the trigger.

6. The safety mechanism of claim 1 wherein the firing pin is slidably mounted in the frame and the hammer has a firing pin activating surface which is separated from the firing pin by a separation S when the hammer is in the hammer fire position, and further wherein said block upper region of said trigger block is configured to reside between said firing pin activating surface on the hammer and the firing pin when said trigger block is in said upper trigger block position, and to transmit a striking force of the hammer to the firing pin, thereby advancing the firing pin into the cartridge as the hammer approaches the hammer fire position, and said block upper region being further configured to reside below the firing pin, thereby assuring that the hammer will not transmit a force to the firing pin when said trigger block is in said lower trigger block position.

7. The safety mechanism of claim 2 wherein said means for maintaining the hammer in a hammer rebound position comprises a spring-loaded plunger mounted in the frame which engages the hammer.

8. The safety mechanism of claim 2 wherein said means for maintaining the hammer in a hammer rebound position comprises:

a coil spring;

a strut seat which is fixably positioned with respect to the frame and engages said coil spring, said strut seat being separated from the hammer by a separation distance D;

a strut of length L, said strut having a strut fork end engaging said coil spring and a strut base end which passes though said strut seat, said strut fork end having a first prong terminating in a first prong tip and a second prong terminating in a second prong tip, said engagement of said strut fork end and said strut seat with said coil spring placing a compression load on said coil spring, and said length L being at all times greater than said distance D; and a fork slot in the hammer which has a first prong tip seat and a second prong tip seat, said first prong tip seat and said second prong tip seat being positioned such that:

when the hammer is in the hammer rebound position, said first prong tip forcibly engages said first prong tip seat and said second prong tip forcibly engages said second prong tip seat such that there is no net torque on the hammer, when the hammer is rotated to the hammer cocked position, said first prong tip forcibly engages said first prong tip seat and said second prong tip is disengaged from said second prong tip seat, thereby serving as the means for biassing the hammer, when released from the hammer cocked position, to rotate towards the hammer fire position, and when the hammer is in the hammer fire position, said second prong tip forcibly engages said second prong tip seat and said first prong tip is disengaged from said first prong tip seat, thereby biassing the hammer to rotate to the hammer rebound position.

9. The safety mechanism of claim 1 wherein said means for biassing said trigger block towards said lower trigger block position when the hammer is in the hammer rest position further comprises:

a spring bearing surface on said trigger block; and a compression spring which engages the frame and said spring bearing surface of said trigger block and which is compressed as said trigger block is moved from said lower trigger block position to said upper trigger block position.

10. The safety mechanism of claim 9 wherein said block lower region engaging surface is provided by the sear of the trigger.

* * * * *